United States Patent [19]

Burnside

[11] Patent Number: 4,484,592

[45] Date of Patent: Nov. 27, 1984

[54] AMUSEMENT APPARATUS WITH HIGH CAPACITY TOKEN STORAGE

[75] Inventor: Walter M. Burnside, Waukegan, Ill.

[73] Assignee: Bally Manufacturing Corporation, Chicago, Ill.

[21] Appl. No.: 380,829

[22] Filed: May 21, 1982

Related U.S. Application Data

[63] Continuation of Ser. No. 153,013, May 27, 1980, abandoned.

[51] Int. Cl.[3] ..... G07D 1/00; G07F 17/34

[52] U.S. Cl. ..... 133/5 R; 221/3; 221/174

[58] Field of Search ..... 133/1 R, 3 H, 5 R, 8 R, 133/8 A; 221/3, 174; 194/DIG. 11; 273/138 A, 143 R

[56] References Cited

U.S. PATENT DOCUMENTS

| | | | |
|---|---|---|---|
| 1,047,470 | 12/1912 | Wigg | 221/3 X |
| 1,389,634 | 9/1921 | Donnellan | 133/8 A |
| 1,776,251 | 9/1930 | Donnellan | 133/1 R X |
| 2,044,320 | 6/1936 | Norris | 273/138 A |
| 2,345,074 | 3/1944 | Sargent et al. | 221/174 X |
| 3,209,883 | 10/1965 | Hopps | 273/143 R |
| 3,612,073 | 10/1971 | Calos | 133/8 R |
| 4,148,331 | 4/1979 | Nicolaus | 133/8 R |

*Primary Examiner*—F. J. Bartuska
*Attorney, Agent, or Firm*—Todd S. Parkhurst

[57] ABSTRACT

Coin-release amusement apparatus dispenses tokens in response to a winning combination and includes a coin-release device for activating the apparatus; a repository for receiving coins from the coin-release device; a token storage and dispensing device separate from the coin-release device for storing a supply of tokens and dispensing controlled quantities of the tokens on a win, the token storage and dispensing device including an upper storage section, a mid transfer section and a lower dispensing section; and a provision to allow replenishing of the token supply without interrupting the operation of the amusement apparatus.

5 Claims, 5 Drawing Figures

51
47
49
43
29
37
31
31
17
63
21
45
77
79
69
81
23
53

77
31
15
73
59
69
61
53
56
57
45
66
45
65
11
79
75
31
81
83
33
77
55
73
71
69
53

AMUSEMENT APPARATUS WITH HIGH CAPACITY TOKEN STORAGE

This is a continuation of application Ser. No. 153,013, filed 05/27/80 now abandoned.

This invention relates to coin-released amusement or game apparatus, and in particular to such apparatus that utilizes coins to release or operate the apparatus but awards tokens rather than coins in response to a winning combination where the apparatus is played.

In certain known types of coin-released amusement and game apparatus, a plurality of symbol-bearing reels will be set into spinning motion to come to rest in various symbol-displaying positions to determine a score or reward. The reel-spinning mechanism is actuated after a coin is deposited in the apparatus to release the apparatus for play and a start mechanism is activated. The symbol-bearing reels may be of the electro-mechanical rotatable drum type. The reels have symbols on their periphery and are generally actuated by a player depressing a start button or pulling a hand lever. At the end of a normal play cycle, the sequential change of symbols is stopped or "indexed" at random by electronic, electrical or mechanical means with each reel or drum displaying a symbol in a player viewing area. Taken together, these symbols form one or more horizontal rows of combinations, and certain of the symbol combinations are winning combinations entitling the player to a reward.

Of these known devices, some provide the reward by dispensing a given quantity of coins in response to a particular winning combination. In others, tokens are used to release the machine for play, and in these play devices, the rewards are dispensed also in tokens, which thereafter are exchanged for money or other prizes.

In these known devices that use tokens, the tokens are generally equivalent in value to a particular coin so that the value of the payout in response to a particular winning combination is the same whether coins or tokens are used. In these devices, the supply of coins or tokens is at least partially replenished by the pieces used to release the apparatus for play. Specific requirements for such apparatus may vary among jurisdictions.

There now is a requirement for certain game apparatus of the foregoing type to utilize money coins to release the apparatus for play, but to utilize only tokens in dispensing the reward in response to a winning combination. Further under these requirements, the tokens can be exchanged only for non-money prizes. In view of these requirements, coins cannot be commingled with tokens, and so in the game devices the coin-release system needs to be separate from the reward dispensing system, and so the supply of tokens utilized in the reward dispensing system cannot be replenished by the pieces inserted in releasing the apparatus for play. In addition, because of a possible lower equivalent value of the tokens the apparatus may have to be set to either dispense awards more frequently or dispense more tokens with each award or both. Accordingly, a greater quantity of tokens is required for use in apparatus meeting these requirements.

Such apparatus needs provision for storing two coin-type pieces, one in the form of actual money coins and the other in the form of tokens. This in itself requires more storage capacity than previously. Furthermore, it is desirable to avoid interrupting game play for replenishing the supply of tokens.

It is an object of this invention, therefore, to provide coin-released amusement apparatus that has two separate coin-piece systems and in which tokens being employed in one of the systems are dispensed in response to each winning combination and that has provision for a high capacity supply of tokens in existing sized and shaped apparatus housings.

It is another object of this invention to provide coin-released amusement apparatus of the immediately foregoing type that has provision for replenishing the supply of tokens without interrupting game play.

Other objects of the invention will become apparent and the invention readily understood from the following description read in connection with the accompanying drawings in which.

Briefly, a coin-released amusement apparatus is shown and described herein. This apparatus is the type in which permutations and combinations are formed by changeable symbol-bearing reels indexed in variously changed relative positions so as to display one or more combinations at a time of the symbols, certain of the combinations being so-called winning combinations which produce rewards.

The particular type of amusement apparatus contemplated within the principles of this invention is the type which dispenses tokens in response to a winning combination, and these tokens are in turn exchangeable for non-money prizes. The system line of tokens in the apparatus is separated from the money coin line utilized in releasing the amusement apparatus in game play. Thus, there is a separate repository means receiving the coins which are directly diverted to it from the coin-release mechanism. Periodically the coins are collected from the repository. Because the money coin system is separate from the reward token system, the supply of tokens cannot be replenished from the input of coins to the release mechanism.

Accordingly, there is provided an amusement apparatus of a known given size and shape which has improved storage capacity means for increasing the storage of tokens by as much as four to five times over the capacity of known apparatus.

In accordance with this invention, a token storage and dispensing means includes an upper storage section, a mid transfer section, and a lower dispensing section. Tokens stored in the system preferably are fed to the dispensing means by gravity, and there is provided means for obstructing the gravity feed at a particular point so that the lower dispensing section can be removed for service when, for example, a token jam is encountered in the feed-out mechanism. Provision is also made for replenishing the token supply without interrupting game operation.

The substantially increased storage capacity of tokens reduces the number of token replenishment times per number of games played. The quantity of tokens needed for the rewards, however, may be considerably increased because of the exchange rate determined by the laws of a particular jurisdiction in which the apparatus is utilized.

Figure 1:
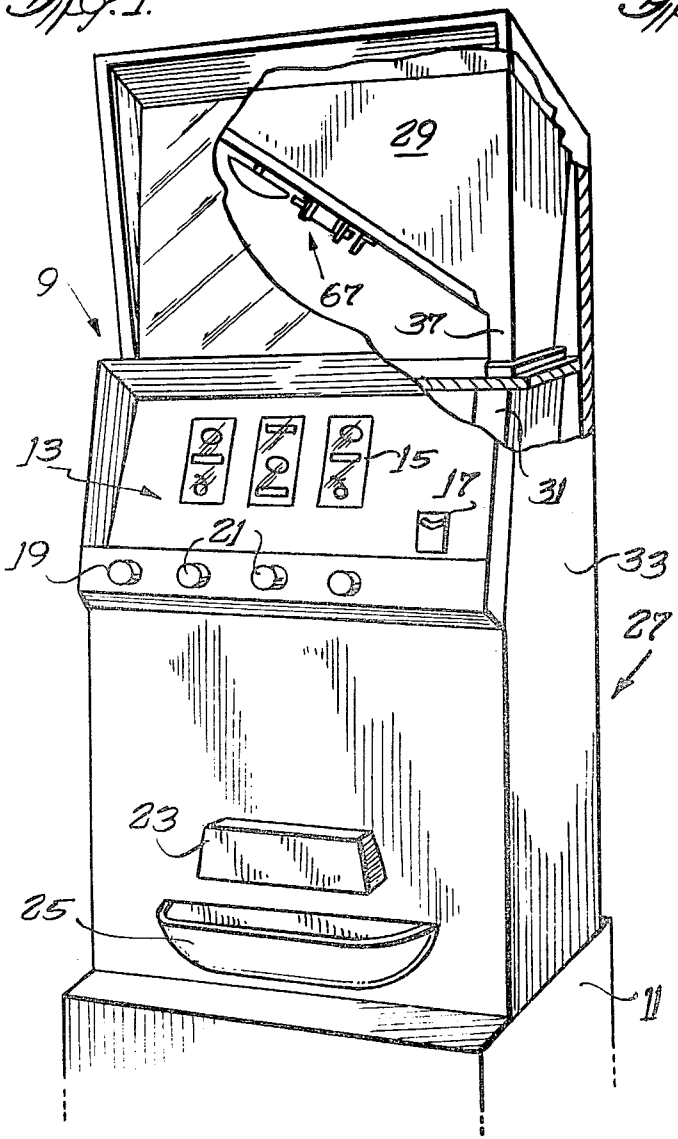
FIG. 1 is a perspective view of coin-released apparatus utilizing the principles of this invention, a portion of the apparatus being broken away to expose certain interior structure.

More specifically and in reference to FIG. 1, there is shown an amusement apparatus or game device 9 which may be of the freestanding, floor model type, but which in the illustration is a table model and is supported by a table or stand 11. The device 9 includes a viewing area 13 behind which are three reels 15 that are rotatable and that have symbols on their periphery. Each rotatable reel is "indexed" at a given stop position of which there is a plurality equally spaced around the reel. There is at least one symbol on the periphery corresponding to each stop position. When the reel is indexed, a symbol is displayed in the viewing area 13.

A player initiates play by first inserting a coin (not shown) in a slot 17 and then depressing a start button 19. In some game devices, play may be initiated by the player pulling a hand lever rather than depressing a start button. This actuates the side by side reels, which thereafter are set into full spin. At the end of a normal play cycle, the reels are stopped or "indexed" at random by the electronic, electrical or mechanical means with each reel displaying a symbol in the player viewing area. In the illustrated embodiment, the reels may also be manually stopped by the player depressing a stop button 21 provided for each reel. The symbols on the indexed reels together form one or more horizontal row of symbol combinations, and certain of these combinations are winning combinations entitling the player to a reward.

In this instance, the reward is in the form of dispensed or paid-out tokens that are ejected from an internal dispensing device against a hood 23 by which they are deflected to fall into a receptacle 25. Thereafter, the player may accumulate the tokens and exchange them for prizes.

The game device is contained in a housing 27, part of which in FIG. 1 is shown broken away in order to view portions of the interior.

The broken away portion in FIG. 1 reveals the upper interior portion wherein is shown an upper token storage section in the form of a bin 29. The bin 29 empties into a mid transfer section in the form of a chute or channel 31 that is disposed along a wall of the housing 27, such as the right side wall 33 as viewed in FIG. 1.

In this connection, it should be understood that although the illustrated embodiment of the game device 9 includes three reels 15, is operated by push button control, is stand-mounted, and includes a bin 29 that is downwardly directed toward the right side (facing the front of the game device), this structure is provided for purposes of illustration and description only. There is no intention of limiting this invention to only this particular game device. It should be clear that the principles of this invention may be applied in other game devices as well. Further in this connection, the particular side of the housing 27 to which the confluence of the lower end or bottom of the bin 29 is directed is not of itself critical. In accordance with this invention, the bottom of the bin could be directed to a channel 31 that is along another of the walls, or not even adjacent a wall at all, i.e., it might be disposed at some other convenient location within the cross-sectional area of the housing 27.

Figure 2:
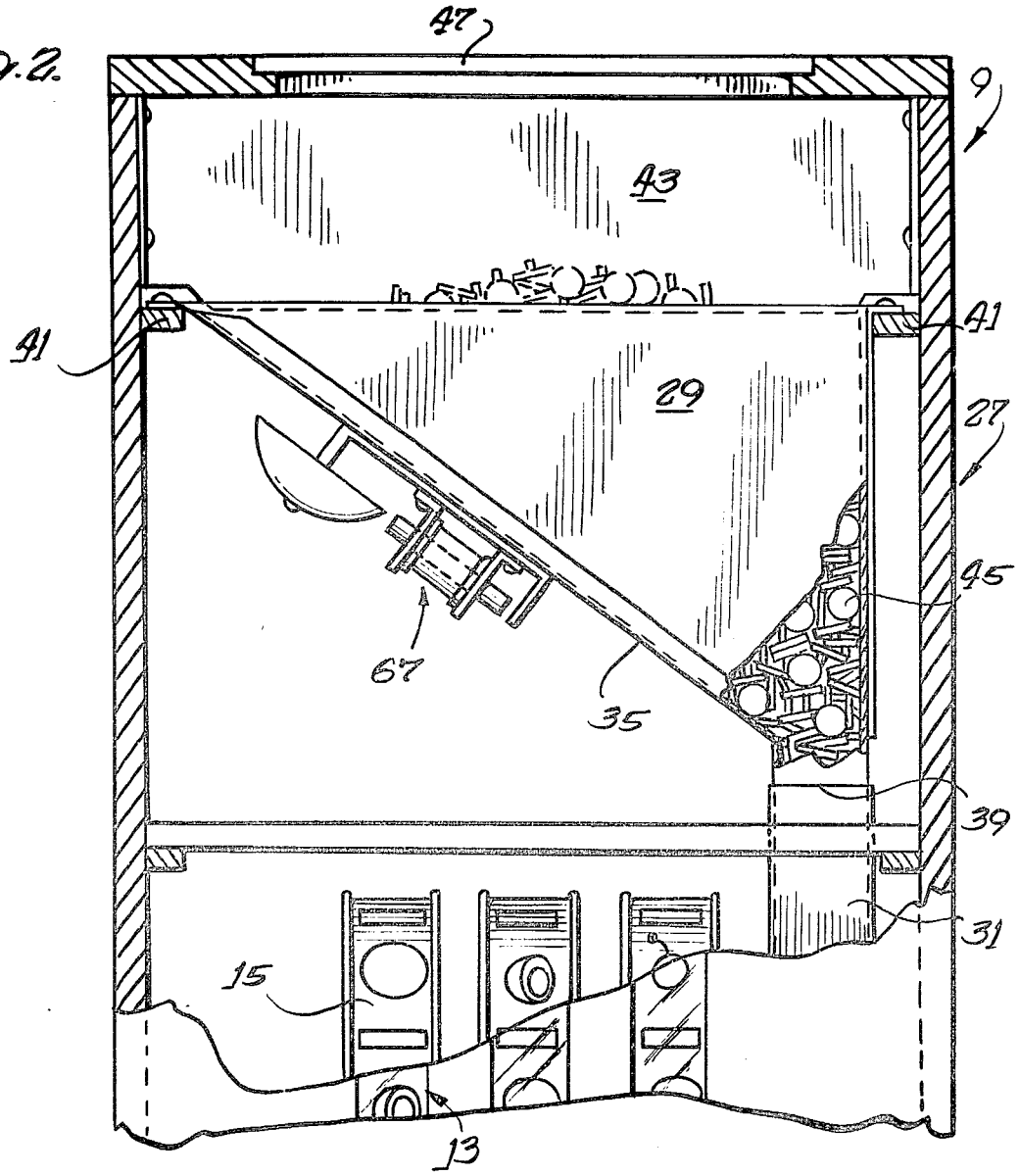
FIG. 2 is an enlarged front view of the upper portion of the apparatus of FIG. 1 also with certain portions broken away.
Figure 3:
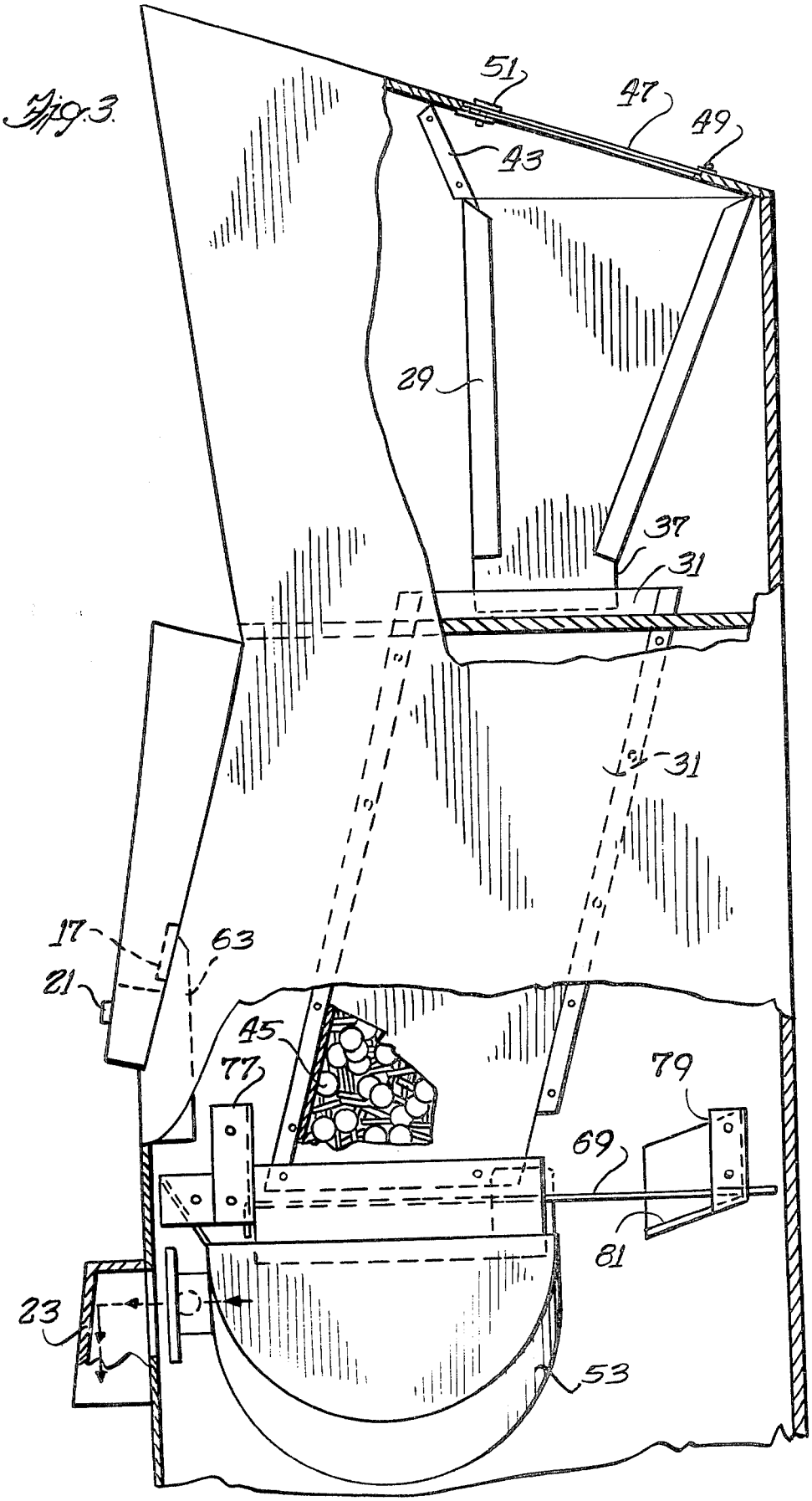
FIG. 3 is a side view of the apparatus of FIG. 1 with certain portions broken away.

Referring now to FIG. 2, it will be seen that a bottom portion 35 is inclined from the upper end of the bin downwardly to the right to a neck 37, the lowest most portion of the bin 29, in which there is an opening 39. Tokens in the bin accordingly gravitate to the opening 39. It will be appreciated by studying FIGS. 2 and 3 that the neck 37 and the opening 39 are rectangular in cross section. The bin 29 is mounted in a suitable manner on either of the side walls by a pair of supports 41 attached to the interior of the housing 27. From the view in FIG. 2, it will be noted that in elevation the bin is in the form of a triangle, while in the side view in FIG. 3, it will be noted that the bin is in the general form of a trapezoid. Also in FIG. 3, it will be seen that an apron 43 is provided at the front upper end of the bin 29, including upwardly from the top front edge of the bin to the inside top of the housing 27. The housing 27 is in accord with an aesthetic design, and its top slopes from the front downwardly to the rear as seen in FIG. 3. Thus, the back of the bin 29 is subjacent the top of the housing 27 at the rear, but only through means of the apron 43 does it extend to a point near the top at its front. In FIG. 2, it will be noted that the apron 43 extends across the entire width of the interior of the housing 27.

The bin 29 is open across its top, and as best seen in FIG. 3, the opening faces upwardly toward an access door 47. The access door 47 is connected along its rear edge to the housing 27 by a suitable means such as a hinge 49. The front edge of the door is latched to the housing in the closed position by a suitable release means such as a lock 51, released only by a proper key. The bin 29 is filled with tokens 45 (FIG. 2) by opening the access door 47 and pouring in a quantity of the tokens until the supply completely fills the bin. The tokens 45 contemplated for use in the device 9 are the physical size of a U.S. twenty-five cent coin also known as a quarter, although other sized tokens could be used as long as the dispensing apparatus and other members of the token system correspond to the size token utilized. In this connection, it will be appreciated that the person replenishing the supply of tokens in the bin 29 can do so from either side, the rear, or even overhead without disturbing a player at the front of the apparatus. As will be seen hereinafter, since the tokens, except for being dispensed as a reward, are not part of the game operation, there is no need, as far as the apparatus is concerned, to interrupt game play to replenish the supply of tokens. Hence, this broad accessibility allows replenishing of the supply of tokens at any time, even during game play. This feature advantageously allows maximum use of the apparatus because of the ability to maintain the supply of tokens without annoying the players.

Preferably, the feeding of the tokens through the system is substantially by gravity. In this connection, the precise form of the bin 29 is not important as long as the bottom portions include a confluence at the lowest portion in which an opening is provided for the feeding out of the tokens. Another consideration in determining the shape or form of the bin 29 is the available space within the game device. It is a feature of this invention that the increased storage capacity for tokens is provided without having to increase the housing sizes or otherwise alter the external shape of existing game designs.

Returning once again to FIG. 2, the neck 37 and the opening 39 of the lowest portion of the bin 29 fits within the channel 31 which is supported to extend along the inside of the right housing wall 33. Referring now to FIG. 3, it will be seen that this channel 31, which is rectangular in cross section, extends downwardly within the housing 27 and toward the front. This generally conforms to the outside shape of the housing front.

The channel 31 is elongated and extends along approximately one-third of the height of the housing 27. Thus, the channel 31 has capacity in its own right for storing the tokens 31, and so the capacity of this mid transfer section adds to the capacity of the upper storage section in providing the embodiment with high capacity token storage.

Figures 4, 5:
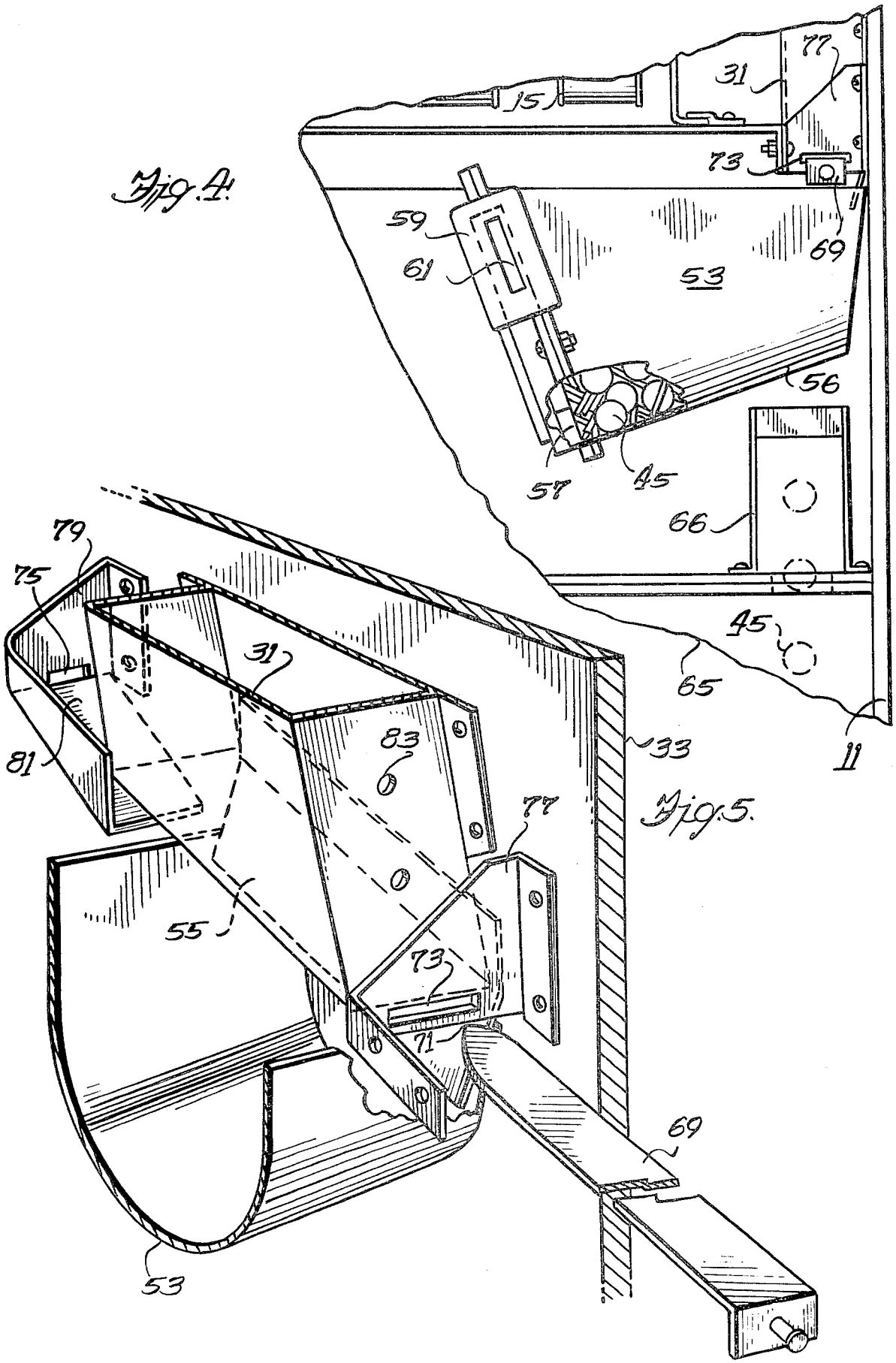
FIG. 4 is a front elevation of a portion of the apparatus of FIG. 1 with portions broken away to expose interior structure.
FIG. 5 is a perspective view of an interior portion of the apparatus of FIG. 1 illustrating the relationship of certain interior members of the apparatus in accordance with the invention.

The channel 31 at its lower end is in communication with a lower dispensing section in the form of a hopper 53 and dispensing wheel 57. As best seen in FIG. 4, the hopper 53 is disposed under the channel 31 in such a manner that the right hand portion of the hopper 53 (as viewed in FIG. 4) receives any tokens passing through the channel 31 to the hopper by gravity. As best seen in FIG. 5, to insure that the tokens are all guided into the hopper 53, a deflector plate 55 is connected at the lower end of the outside wall portion of channel 31. This plate angles inwardly and over the upper edge of the hopper 53.

Returning once again to FIG. 4, the hopper 53 has an inclined bottom 56 that is downwardly directed to the left end of the hopper (as viewed in FIG. 4) so that the tokens will gravitate to this lower left portion of the hopper. The dispensing wheel 57 is provided at the left end of the hopper 53. This dispensing wheel is electrically operated and may be of the type conventionaly used in coin counter and dispensing devices. Near the upper front portion of the hopper there is provided a base plate 59 having a slot 61 therein. From this slot 61, the dispensing wheel ejects the coins which, as may be seen in FIG. 3, are thrown against the hood 23 and deflected downwardly to the receptacle 25 (FIG. 1). The dispensing or payout occurs in response to a winning combination as indicated earlier. The quantity of tokens 31 dispensed is in accordance with the value assigned the particular winning combination.

A coin receptor and release mechanism 63 (FIG. 3), which may be of the conventional type, receives the coins inserted by the player in initiating the play process. These coins are kept separate from the tokens and are diverted to a repository 65 shown in FIG. 4 via a coin chute 66. This cash repository may be located in the base of floor models or in the stand 11 as shown in FIG. 4 in the instance of table models. The cash is collected separately from the replenishing of the tokens, and access is gained to the cash repository by appropriate openings (not shown) in the stand as conventionally provided for such apparatus.

Typically, such game devices utilize audible signals to indicate winning combinations. In this instance, and referring to FIGS. 1 and 2, this audible signal is in the form of an electrically operated bell assembly 67. This bell assembly is mounted on the under surface of the inclined bottom of the bin 29 and serves a dual purpose. In addition to providing an audible to signal a win, the bell assembly provides vibrations which serve to assist the gravitation of tokens downwardly along the inclined bottom to the discharge opening 39.

Referring once again to FIG. 5, there may be occasions when the tokens in the hopper jam the dispensing mechanism, resulting in the need for removing the hopper-dispensing assembly from its location for access to free the jam. An obstruction means in the form of an elongated flat member 69 is provided to prevent the overhead supply of tokens from pouring out into the interior of the housing upon removal of the hopper-dispensing assembly. This flat member 69 has a snub nose 71 that is useful in directing it through the supply of tokens when the flat member is inserted to form the obstruction. A pair of opposing slots 73 and 75 are provided in a pair of brackets 77, 79 respectively along side and at the lower end of the channel 31. These brackets are fastened by suitable means to the exterior side wall 33 of the housing. The slots are made as small as possible consistent with the ability of each slot to receive the insertion of and retain the elongated flat member 69. The bracket 79 is spaced away from the channel 31 toward the rear of the housing (FIGS. 3 and 5) and includes a ramp 81 the distal end of which is below a horizontal line joining the slots to receive and guide the lead end of the flat member 69 into the slot 75. The member 69 may be stored on the inside of the housing 27 in a convenient vacant area until needed. Once inserted in the slots, the elongated member is large enough with respect to the interior of the channel 31 to effectively obstruct the quarter-sized tokens from a downward movement past the inserted member. It will be noted that the brackets are disposed so that the slots will be located just subjacent the lower opening of the channel 31.

The bin 29 and the chute 31 may be made of cold rolled light gage metal utilizing conventional fastening means to mount these members to the housing. A series of small ports 83 (FIG. 5) may be provided in the channel 31 and the bin 29 at periodic intervals as a means of quickly determining the supply level of the tokens and, if necessary, as an access opening to insert a small rod to free the tokens should they become compacted and jam in the channel.

In operation, the bin 29, channel 31, and hopper 53 combination forms a high capacity storage for quarter-sized tokens 45 which are paid out on a win to be exchanged for non-money prizes. The quantity of tokens on each payout will be in accordance with the value assigned to each of the various winning combinations. A player initiates play on the game device 9 by inserting a money coin in the slot 17 provided for this purpose. The coin releases the apparatus for play, and the player actuates the game device by depressing the start button 19. The reels 15 are then set in spinning motion to be sequentially stopped thereafter either by the internal means provided or by the player manually depressing the corresponding buttons 21.

The coin inserted in the slot 17 passes through the coin receptor and release mechanism 63 and thence into the cash repository 65 inside the base or stand 11. The coin then remains in the repository until collected by an attendant. When reels 15 are stopped, a combination of symbols on the periphery of the reels are aligned in one or more rows in the viewing area 13. Certain of these combinations are predetermined as winning combinations, and when winning combinations occur, a bell assembly 67 is energized and a specific quantity of tokens is ejected from the hopper 53 through the slot 61. These ejected tokens strike the inside of the hood 23 and fall into the receptacle 25 below. Because the supply of tokens is separate from the coin infeed, there is no automatic replenishing of the tokens, and the supply diminishes as tokens are dispensed.

The access door 47 in the top of the housing 27 is immediately above the upwardly facing opening in the bin 29, and access to this door 47 for replenishing the supply of tokens may be had without interrupting the player standing in front of the game device during play.

An example of a game device 9 that has been constructed in accordance with the principles of this invention provides a total storage capacity of approximately 5,000 quarter-sized tokens. If a jam occurs in the token dispensing mechanism, the front of the housing may be opened for removal of the token hopper-dispensing mechanism. Before such removal, however, the elongated flat member 69 is inserted in the pair of slots 73, 75 to obstruct the gravity feed of tokens from the overhead storage in the channel 31 and bin 29. A blunt nose 71 is provided on the elongated member and a guide ramp 81 is provided the far slot to assist the insertion of the obstructing member 69. After the hopper-dispensing mechanism is returned, the elongated member 69 is removed and placed in some convenient location within the housing 27 to be retained until next use. The high capacity token storage enables long periods of game play between token replenishing.

There has been provided in accordance with this invention a coin-released amusement apparatus which dispenses token rewards in response to winning combinations. The apparatus includes coin-release means for activating the apparatus, repository means for receiving coins diverted directly to the respository from the coin-release means, token storage and dispensing means separate from the coin-release means for storing a supply of tokens and dispensing controlled quantities of the tokens when a winning combination occurs. The token storage and dispensing means includes an upper storage section, a mid transfer section, and a lower dispensing section. The apparatus also includes means for replenishing the token supply without interrupting game operation.

While the invention has been described in connection with a preferred embodiment, alternatives, modifications, and variations may be apparent to those skilled in the art in view of the foregoing description. Accordingly, it is intended to embrace all such alternatives, modifications, and variations as fall within the spirit and scope of the appended claims.

What is claimed is:

1. Coin-released amusement apparatus which dispenses tokens in response to a winning combination, comprising, in combination;

an elongated upright substantially closed housing having a top end, amusement apparatus supported within said housing in spaced relation to said top end so as to define an upper chamber within said housing, said amusement apparatus being operative to provide a predetermined winning combination, coin-release means disposed within said housing and having a coin receptor mechanism responsive to insertion of a coin for activating the apparatus, repository means adapted to receive coins diverted directly thereto from said coin-release means, token storage and dispensing means within said housing separate from said coin-release and repository means and adapted to store a supply of tokens and dispense selected quantities of tokens in response to said predetermined winning combination, said token storage and dispensing means including an upper storage bin disposed within said upper chamber above said amusement apparatus, said bin having an open upper end and being tapered downwardly to a discharge opening such that coins disposed within said bin gravitate toward said opening, a channel disposed within said housing and extending generally longitudinally of said housing alongside the amusement apparatus, said channel having an upper end adjacent said opening in said bin so as to receive tokens therefrom and having a volumetric capacity sufficient to receive a substantial quantity of tokens therein, a downwardly inclined hopper disposed within said housing and having communication with the lower end of said channel so as to receive tokens therefrom and enable downward gravitational movement of tokens within said hopper, an automatic token ejector connected to and forming one generally upright wall of said hopper downstream from the token receiving end thereof, said automatic token ejector being operative in response to said winning combination to dispense one or more tokens in controlled quantities from the hopper through a discharge opening in said housing for access by a player, access means in the top of said housing overlying said upper open end of said bin to facilitate replenishing of tokens within said token storage and dispensing means without interrupting play of the amusement apparatus, and means including a longitudinally movable blocking member at the lower end of said channel and cooperative with said channel to selectively obstruct gravity feed of tokens from said bin and channel to said hopper so as to enable removal of said hopper and dispensing means from beneath said channel for service without tokens in said bin and channel passing therefrom.

2. Apparatus in accordance with claim 1 wherein said obstructing means includes a pair of guide slots in brackets adjacent opposing end walls of said channel, said blocking member comprising an elongated flat member adapted for insertion through the guide slots and operative to close off said channel when the obstruction is to be effected.

3. Apparatus in accordance with claim 1 further comprising vibrating means on the underside of the bottom of said bin to assist the gravitation of tokens toward said discharge opening.

4. Apparatus in accordance with claim 3 wherein said vibratory means is an audio signal device utilized in conjunction with the operation of the amusement apparatus.

5. Apparatus as defined in claim 1 wherein said channel includes access ports enabling visual determination of the level of tokens therein, said access ports facilitating insertion of a rod to free jammed tokens.

* * * * *